United States Patent [19]

Bruneau

[11] Patent Number: 4,605,189

[45] Date of Patent: Aug. 12, 1986

[54] ANTI-FAIL DEVICE FOR LOCKING A DRAWING-BOARD PILLAR AGAINST MOTION

[75] Inventor: Alain Bruneau, Montferrand le Chateau, France

[73] Assignee: Alpia S.A., Besancon, France

[21] Appl. No.: 641,499

[22] Filed: Aug. 16, 1984

[30] Foreign Application Priority Data

Sep. 7, 1983 [FR] France ..... 83 14564

[51] Int. Cl.[4] ..... F16M 11/00

[52] U.S. Cl. ..... 248/162.1; 248/123.1; 108/146; 108/6

[58] Field of Search ..... 248/544, 162.1, 161, 248/572, 573, 123.1, 125, 411, 334.1; 108/6, 8, 10, 146

[56] References Cited

U.S. PATENT DOCUMENTS

| | | | |
|---|---|---|---|
| 2,404,949 | 7/1946 | De Lisle | 108/146 |
| 3,096,059 | 7/1963 | Johnson | 248/162.1 |
| 3,213,809 | 10/1965 | Kritske | 108/146 |
| 3,358,620 | 12/1967 | Parigi | 108/6 |
| 3,370,556 | 2/1968 | Kooi | 108/146 X |
| 3,543,282 | 11/1970 | Sautereau | 108/6 X |
| 4,111,389 | 9/1978 | Gundlach et al. | 248/162.1 |
| 4,360,180 | 11/1982 | Bruneau | 248/162.1 |
| 4,557,450 | 12/1985 | Bruneau | 248/162.1 |

*Primary Examiner*—Ramon S. Britts
*Assistant Examiner*—David M. Purol
*Attorney, Agent, or Firm*—Robert E. Burns; Emmanuel J. Lobato; Bruce L. Adams

[57] ABSTRACT

Permanent locking mechanism can be released temporarily by depressing a pedal when adjusting the height and orientation of the drawing board. The movable assembly comprising the table supporting pillar is connected to the balancing system by a cable attached at one end to a spring passing around a return pulley having its axle supported by a strap of which the corresponding notch is directed towards the base of the frame structure, then around another return pulley formed with a helical groove and secured to the top of the frame structure, the other end of the cable being attached to the pillar. A locking member interconnects the axle and the pedal, this connection being discontinued in case of undesired slackening or breakage of the cable.

5 Claims, 4 Drawing Figures

ANTI-FAIL DEVICE FOR LOCKING A DRAWING-BOARD PILLAR AGAINST MOTION

FIELD OF INVENTION

The present invention relates to an anti-fall or safety device for locking a drawing-board pillar against motion in case of failure of the means for balancing the weight of the movable assembly supporting a drawing board surface and slidably mounted in a frame structure. The locking means are adapted to be released temporarily by depressing a pedal disposed externally of said frame structure when it is desired to adjust the vertical and directional position of the drawing board.

THE PRIOR ART

A French document No. 79 19256 describes a device for locking and balancing the drawing or working surface of a drawing board supported by a central pillar adapted to slide in the stand provided with guide means and supported by a base plate, said means consisting of at least two brake shoes diametrally opposed with respect to the geometrical axis of the sliding pillar and constantly urged by mechanical means against the inner surface of said pillar and by a gas cylinder reacting with one end against said base plate and having its other end, provided with a pulley, attached to a cable. This known structure is characterized by the fact that a safety or anti-fall device consists of a rocker having its fulcrum secured substantially at mid-height of the pillar support, one arm of said rocker receiving therethrough a rod controlling the brake shoes and carrying one of the cable anchoring points, the other cable anchoring point being located at the bottom of said pillar. The other arm of the rocker is connected to a compensation spring having its traction point secured to said support.

SUMMARY OF THE INVENTION

It is the essential object of the present invention to provide a simpler and therefore more economical safety device capable of meeting the most severe safety and efficiency requirements in order to preclude any accidental fall of the drawing board in case of failure of the balancing means.

For this purpose, the movable assembly comprising the pillar supporting the drawing board proper is connected through a cable to the balancing means, this cable being tensioned at one end by a spring passing around a first return pulley having its axle rotatably mounted in a strap secured to the base of the frame structure. The notch formed in the strap for receiving the pulley axle opens downwards, i.e. towards the base structure. Then the cable passes around a second return pulley provided with a helical groove and mounted to the top of the frame structure, the opposite end of the cable being anchored to the pillar but at the end opposite the board supporting end.

A locking member interconnects the axle of the first return pulley (which is freely engaged in its notch) and the pedal controlling the release of the means for constantly locking the pillar so that this interconnection is interrupted instantaneously in case of slackening or breakage of the cable.

The locking means consists of a one-piece plate comprising two sections of unequal width from a common linear base, the resulting shoulder comprising one of the anchoring holes for a spring, the other anchoring point of this spring being located on the frame structure. The narrow section has a rounded end constituting a feeler, and the wide section, at its end opposite said rounded end, has two superposed notches formed therein, one notch, which is the notch remotest from the linear base of the locking member, having a bayonet configuration for locking engagement by the rod controlling the permanent locking of the pillar. The other notch is straight and aligned to the longitudinal centre line of the feeler, and adapted to receive a pin interconnecting the locking member and the pedal controlling the release of said braking means.

The strap supporting the axle of the first return pulley comprises on its axis of symmetry a guide member and the distance from this guide member to the bottom of the strap is smaller than the width of the feeler section of said locking member.

A draw-spring having one end anchored to the locking member and its other end attached to the frame structure constantly exerts on the locking member a tractive force necessary and sufficient for keeping the rounded end of the feeler between the axle of the first return pulley and the guide member secured to the strap, so that in case of slackening or breakage of the cable the locking member will be pulled by said draw-spring to the extent necessary for extracting from its notch the pin interconnecting the locking member and the control pedal.

With this arrangement the movement of the movable assembly is stopped immediately in case of failure of the cable or of another component element of the kinematic chain of the balancing means.

In combination with the means for adjusting the height of the drawing board by temporarily opening the brake shoes surrounding the pillar, in case of failure of the cable during this operation the locking member urged by a spring will neutralize the control pedal and the brake is re-applied immediately.

Other advantageous features of the invention will appear as the following description proceeds with reference to the accompanying drawings showing a typical form of embodiment of the invention.

THE DRAWINGS

DESCRIPTION OF THE PREFERRED EMBODIMENT

Figure 1:
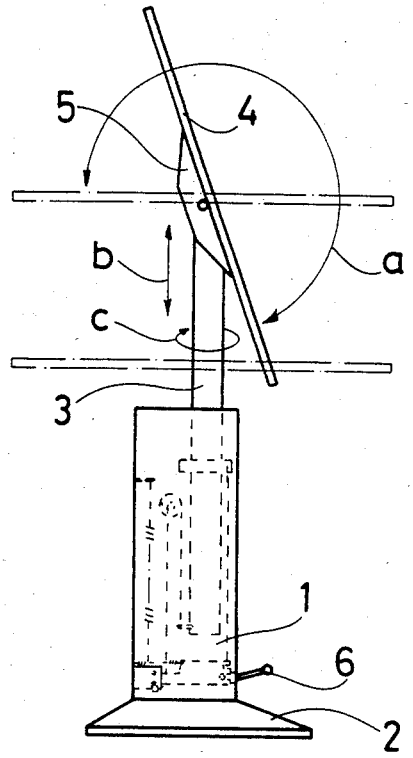
FIG. 1 is a general and diagrammatic view of the drawing board.

Referring first to FIG. 1, the drawing board illustrated diagrammatically therein comprises essentially a frame structure 1, having a base 2, in which a pillar 3 supporting the drawing board proper 4 by means of a pivoted iron fitting 5 is slidably mounted. Means for balancing or compensating the weight of the movable assembly are shown in dash lines, just as a reminder. The arrows a,b,c show the three orientations applicable to the drawing board 4. A pedal 6 is disposed externally of the frame structure just above the base 2 for enabling the user to release the brakes normally locking the movable pillar 3 so that the board can be set in the desired position and orientation. This locking device is disclosed in the French document No. 82 16328.

Figure 2:
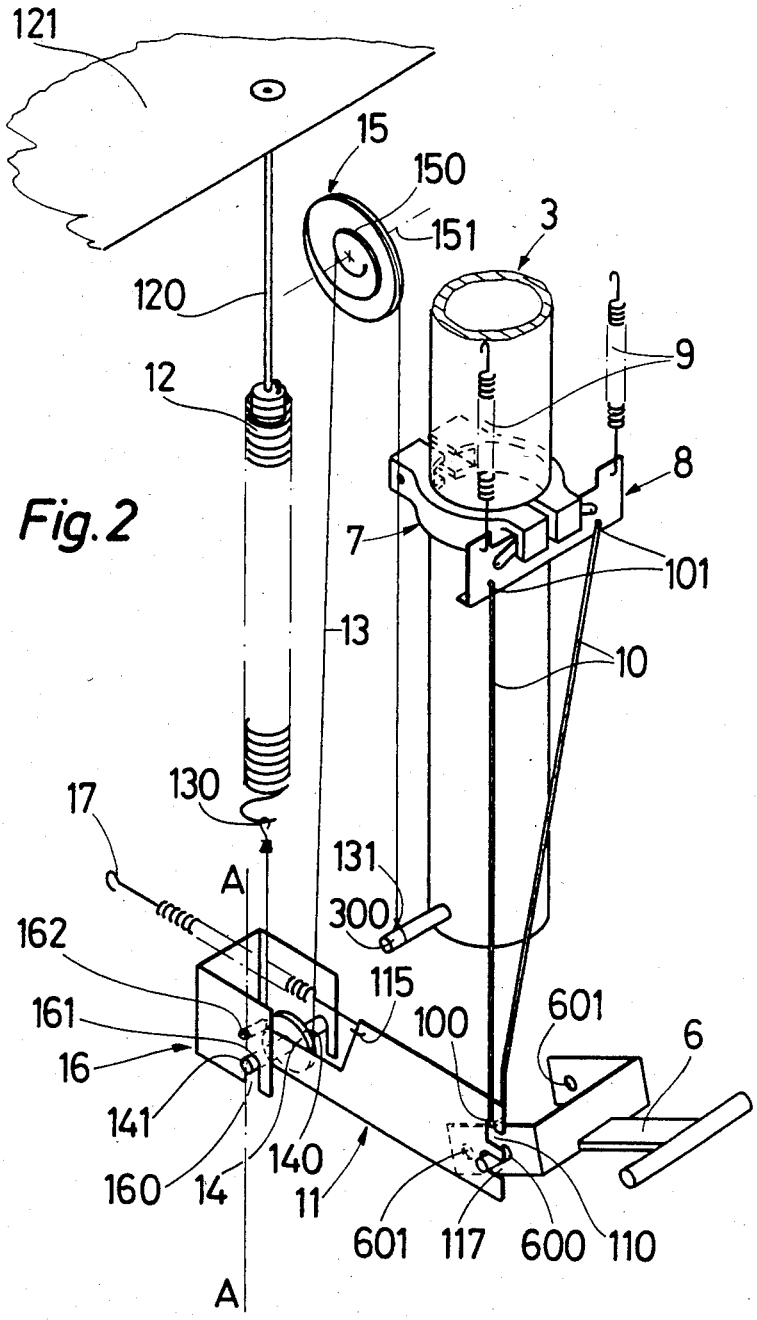
FIG. 2 is a diagrammatic perspective view showing the device in its normal position.

FIG. 2 illustrates the safety device in its normal position in the frame structure 1. The means for permanently locking the pillar 3 comprise a constantly operating brake 7 adapted to be released under the control of a plate 8 suspended by means of a pair of draw-springs 9 attached to the frame structure, the pedal 6 connected to this plate 8 by a pair of rods 10 engaging on the pedal side a hook 110 formed in a locking member 11 also referred to as a connecting plate.

The means for compensating the weight of the movable assembly including the pillar 3 and the drawing board 4 comprise another spring 12 attached to the frame structure by means of a turnbuckle 120 or like tensioning device secured to a corner plate 121. At the opposite end the spring 12 is attached to one end 130 of a cable 13.

This cable 13 engages the groove 140 of a first return pulley 14 and then the helical groove 150 of a second return pulley 15 before being anchored at its other end 131 to a hook 300 fixed to the end of column 3 which is opposite the end supporting the drawing board 4.

The axle 141 of pulley 14 is adaped to rotate freely in a strap 16 secured to the frame structure 1 adjacent the base 2 thereof. This axle is retained in the bottom of strap 16 only by the tension of cable 13. In case of breakage of cable 13 the axle 141 escapes from the notch of strap 16 due to the weight of pulley 14 since the axis of symmetry AA of strap 16 is vertical and the opening of its notch 160 is facing downwards, that is, towards the base 2. The shaft 151 of the second pulley 15 is secured to the frame structure 1 at the point remotest from strap 16 as consistent with the variation in height contemplated for the positioning of the drawing board by controlling the sliding movement of pillar 3.

The strap 16 comprises along said axis AA a guide member 162 located at a distance from the bottom 161 which is determined as a function of the width of the feeler 111 of locking member 11, said distance being smaller than said width.

FIG. 2 shows the locking member 11 interconnecting said axle 141 of the first return pulley 14 and the pedal for releasing the brake 7.

Figure 3:
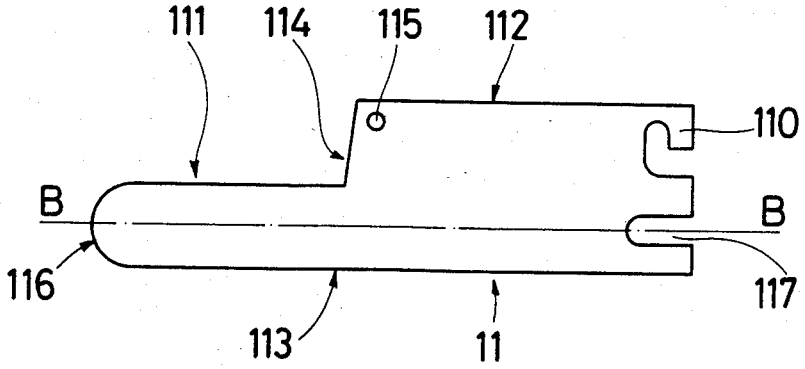
FIG. 3 is a plan view of the locking member, and device in its normal position.

This locking member 12 [FIG. 3] consists in fact of a one-piece flat plate comprising two sections 111 and 112 of unequal width measured from a common linear base 113, the shoulder 114 thus formed having a hole 115 formed close thereto for anchoring one end of a draw-spring 17 of which the other end is anchored to the frame structure 1. The narrow section 111 has a rounded outer end 116 and constitutes a feeler normally urged by draw-spring 17 between the guide member 162 and the axle 141 of return pulley 14.

The wide section 112 has formed in its end opposite the feeler 111 two superposed notches 110,117, of which the upper one 110, i.e. the notch remotest from the linear base 113, has a bayonet configuration and is engaged by one end 100 of the rod 10 controlling the means for permanently locking the pillar 3, and consequently the brake 7. The other end 101 of rod 10 is connected to the brake release plate 8. The other notch 117 is aligned to the longitudinal axis of symmetry BB of feeler 111 and is engaged by a pin 600 rigid with pedal 6, on this side of the fulcrum axis 601 of the pedal.

Figure 4:
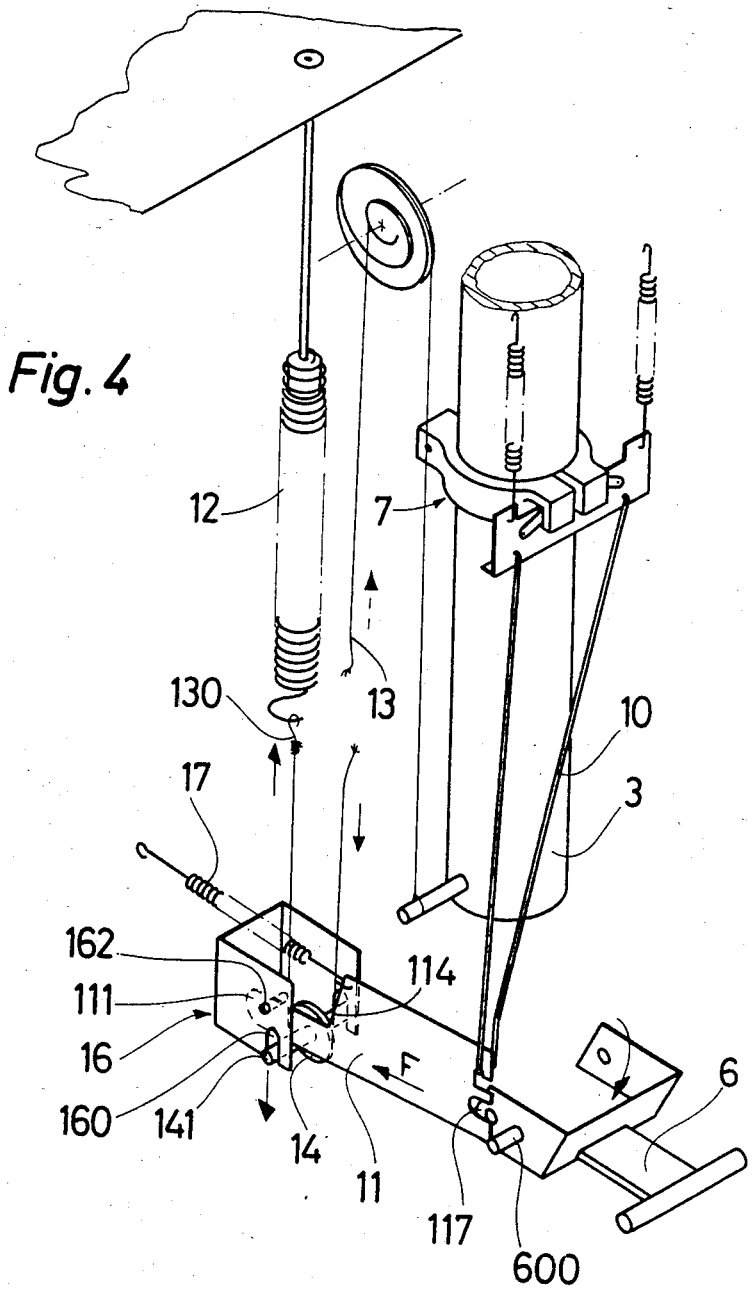
FIG. 4 is a view similar to FIG. 2 but showing the device in the position obtained after a cable failure.

FIG. 4 illustrates the action exerted by locking member 11 in case of failure of cable 13.

Assuming that the cable 13 breaks off as shown in FIG. 4. Since the first return pulley 14 is no more retained by the cable in strap 16, the pulley axle 141 will be urged toward the bottom of notch 160 by the feeler 111 pulled by draw spring 17 under the guide member 162. The locking member 11 recedes in the direction of the tractive force F of spring 17 until the shoulder 114 engages the strap 16. This movement of locking member 11 causes the pin 600 to escape from its notch 117, thus disconnecting the pedal 6. Under these conditions, the brake 7 cannot be released and the pillar 3 remains locked in its initial position without causing any breakage of parts whatsoever.

Though a single form of embodiment of the present invention has been shown and described herein, it will readily occur to those conversant with the art that various modifications and changes may be brought thereto without departing from the basic principles of the invention.

What is claimed is:

1. A drawing board construction comprising a frame structure including a base, a vertical pillar guided by said frame structure for movement vertically relative to said frame structure, a drawing board proper pivotally mounted on said pillar, means for counterbalancing the weight of said pillar and drawing board proper, said counterbalancing means comprising a pulley rotatably supported by said frame structure, a cable passing over said pulley and attached to said pillar and spring means for tensioning said cable, spring actuated locking means for frictionally gripping said pillar to hold it in selected position, user actuated means for releasing said locking means to permit movement of said pillar relative to said frame structure, said releasing means comprising a foot pedal pivotally mounted on said base and tension members connecting said foot pedal with said locking means, and safety means responsive to slackening or breaking of said cable for disconnecting said foot pedal from said tension members in the event of slackening or breaking of said cable, whereby said locking means cannot be released by operation of said foot pedal.

2. A drawing board according to claim 1, in which said safety means comprises a connecting plate having a first notch receiving said tension members and a second notch receiving a pin on said foot pedal, means for biasing said connecting plate in a direction to disconnect said pin on said foot pedal from said second notch, said connecting plate further having a feeler portion or sensing breaking or slackening of said cable, whereby upon slackening or breaking of said cable said feeler portion permits movement of said connecting plate by said biasing means to disconnect said connecting plate from said pin on said foot pedal.

3. A drawing board according to claim 2, in which said counterbalancing means further comprises a further pulley having an axle guided by said frame structure for movement vertically betweeen an upper position and a lower position, said further pulley being normally held in said upper position by the tension of said cable and being released to fall to said lower position in the event of slackening or breaking of said cable, the axle of said further pulley engaging said feeler portion of said connecting plate when said further pulley is in its upper position to hold said connecting plate in position for engagement of said pin on said foot pedal in said second notch, said connecting plate being released upon movement of said further pulley to its lower position to permit movement of said connecting plate by said biasing means to a position in which said pin on said foot pedal is disengaged from said second notch to thereby disconnect said foot pedal from said locking means.

4. A drawing board according to claim 3, in which said connecting plate comprises a wider portion in an end of which said first and second notches are provided and a narrower portion constituting said feeler portion.

5. A drawing board according to claim 4, in which said first notch is a bayonnet connection shaped notch and said second notch is a straight notch.

* * * * *